United States Patent [19]

Sonenstein

[11] 4,265,778

[45] May 5, 1981

[54] SOAP BAR

[75] Inventor: Gerard G. Sonenstein, Yardley, Pa.

[73] Assignee: Colgate-Palmolive Company, New York, N.Y.

[21] Appl. No.: 32,793

[22] Filed: Apr. 23, 1979

Related U.S. Application Data

[63] Continuation of Ser. No. 825,350, Aug. 17, 1977, abandoned.

[51] Int. Cl.[3] ..... C11D 9/30; C11D 15/04

[52] U.S. Cl. ..... 252/117; 252/108; 252/132; 252/134; 252/DIG. 2; 252/DIG. 5; 252/DIG. 15; 252/DIG. 16

[58] Field of Search ..... 252/108, 117, 132, 134, 252/DIG. 2, DIG. 5, DIG. 15, DIG. 16

[56] References Cited

U.S. PATENT DOCUMENTS

| | | | |
|---|---|---|---|
| 3,576,749 | 4/1971 | Megsow et al. | 252/132 |
| 3,799,880 | 3/1974 | Kelly et al. | 252/132 X |
| 3,914,403 | 10/1975 | Valan | 252/DIG. 2 |
| 4,014,807 | 3/1977 | Werner et al. | 252/132 |
| 4,048,301 | 9/1977 | Papantoniow | 252/DIG. 2 |

*Primary Examiner*—Mayer Weinblatt

*Attorney, Agent, or Firm*—Herbert S. Sylvester; Murray M. Grill; Norman Blumenkopf

[57] ABSTRACT

A bar soap is provided having improved crack resistance, a more stable, creamier and unusually large volume of lather, outstanding lubricity and noticeable softening, smoothness, and anti-irritating effects on the skin after use. The soap bars comprise conventional soap formulations and "combars" (soap and synthetic detergent) and as additives to provide the aforementioned benefits from about 0.1 to about 15% by weight of an anionic polymaleic electrolyte.

9 Claims, No Drawings

SOAP BAR

This is a continuation of application Ser. no. 825,350 filed Aug. 17, 1977, and now abandoned.

The present invention relates to new soap compositions of improved resistance to cracking, containing anionic polymaleic electrolyte, which compositions also are characterized by a more stable, creamier, and larger volume of foam than the composition absent the anionic polymaleic electrolyte. The products of this invention generally also exhibit noticeable softening and smoothness effects on the skin, and, additionally, anti-irritating properties as well.

Soap compositions and particularly soap bars generally contain up to about 20% water, the water being an essential component which permits the working and forming of the soap into bars. The presence of water in soap bars however creates cracking problems in finished soap especially upon aging. During aging undoubtedly crystalline phase changes and moisture migration contribute to the dimensional instability of the bar. It has now been discovered that certain anionic polymaleic compounds when added to soap compositions used to produce soap bars provide excellent dimensional stability to the bars and afford outstanding anti-cracking characteristics to the soap bars. In addition it has been discovered that many other desirable attributes of the soaps are favorably influenced. Thus, one finds that the resultant soap bars give a creamier and longer lasting foam and more of it. Further a decided softening or "emollient" effect, along with a definite "smoothness" is obtained on the skin.

Numerous polymers have been added to soap, e.g. in U.S. Pat. No. 3,383,320, a thermoplastic resin is used as a matrix for soap to maintain the original dimensions of the bar; in British Pat. No. 1,288,805, water-insoluble polymer particles are added to soap to provide a "smooth" feel; in U.S. Pat. No. 3,819,525, solid, granular, 25–300 mesh polyvinyl alcohol is used in soap to provide a mild abrasive action to cleanse the skin; in U.S. Pat. No. 3,278,444, polymeric sulfonates such as polystyrene sulfonate are added to soap to improve resistance to sloughing; in U.S. Pat. No. 2,938,887, copolymers of an aromatic vinyl compound and a diester of an unsaturated dicarboxylic acid are suggested as lime soap curd dipersants. There is however no known prior art relating to the use of the anionic maleic copolymers of this invention in soap bars and certainly no teaching of the many unexpected benefits which would derive therefrom.

Polymaleic compounds have been disclosed in non-bar detergent compositions particularly as phosphate substitutes (see U.S. Pat. No. 3,764,559); to improve laundry whiteness maintenance properties (see U.S. Pat. No. 3,794,605); with soap as an additive to non-ionic crutcher slurries to produce spray dried particulate product, but again there is no teaching or indeed suggestion of the use of the instant maleic copolymers in soap compositions to produce bars, and especially soap bars of the unusual properties of the products of this invention.

The anionic maleic copolymers useful in the present invention are interpolymers of (a) maleic anhydride and/or the partial ($C_1$ to $C_4$) alkyl or substituted alkyl (e.g., QH, etc.) esters thereof with (b) lower ($C_1$ to $C_4$) alkyl vinyl ethers, vinyl esters (of $C_2$ to $C_6$ monocarboxylic acids), vinyl lactams, e.g. vinylpyrrolidone, vinyl morpholinone, vinyl oxazolidinone, etc. (5-, 6-, or 7-membered hetero rings), or mixtures thereof. It will be understood that the free acid or anhydride forms of these interpolymers or copolymers as described and claimed herein are equivalent to the watersoluble salts thereof, e.g. with alkali metals such as sodium and potassium, ammonium and amines as described below. Similarly, equivalents of the maleic moiety include fumaric, citraconic and other lower alkyl-substituted maleic groups.

The above vinyl lactams may be represented by the formula:

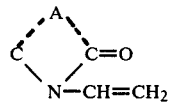

wherein A represents 2, 3 or 4 independently selected carbon, nitrogen, oxygen or sulfur atoms.

The interpolymers are generally equimolar products (1:1) but products containing as little as about 10 mole % maleic anhydride and up to about 90 mole % are useful (approximately 9:1 to 1:9 mole ratio of maleic anhydride and comonomer). The amount of the anionic maleic copolymer may range from about 0.1 to about 15%, preferably about 0.5 to 10%, and more preferably about 1 to 10% by weight based on the dry weight of soap present. Particularly outstanding effects are obtained using about 1 to 5% of the copolymer based on the weight of the soap.

The soap compositions of the present invention comprise a water-soluble fatty acid salt. Suitable salts are the sodium, potassium and other alkali metal, ammonium and lower molecular weight amine salts, e.g. mono-, di-, and tri-ethanol, -pentaethoxyethanol, -triethoxymethyl amines and the like. The preferred soaps are sodium soaps. The useful fatty acids are generally $C_8$ to $C_{24}$ acids, more preferably $C_{12}$ to $C_{18}$, and may be saturated and/or unsaturated (mono and poly). The commercial soaps are predominantly derived from tallow and/or hydrogenated tallow (tallow and hydrogenated tallow fatty acids) and coconut oil and/or hydrogenated coconut oil (i.e., fatty acids) and mixtures thereof. Other conventional sources of fatty acids are cotton-seed oil, soya bean oil, corn oil, olive oil, palm oil, peanut oil, fish oils, etc. Preferred soaps contain about 50–95% tallow fatty acids and about 5–50% coco fatty acids. Most preferred are soaps of about 70–90% tallow fatty acids and about 10–30% coco fatty acids. Synthetic fatty acids may also be used. These contain a significant amount (10–50%) of branched chain fatty acids. A particularly useful soap is one derived from about 80–88% tallow acids and about 12–20% coco acids.

The soap bars of the present invention may contain a minor amount based on the soap present of e.g. about 1–10%, up to a significant amount (e.g. about 20–100%) of a non-soap detergent, based on the soap weight. Examples are α-sulfonated $C_{10}$–$C_{20}$ fatty acid esters as described in U.S. Pat. No. 3,223,645; higher ($C_{10}$–$C_{20}$) alkyl ether (1–30 moles ethylene oxide) sulfonates; paraffin sulfonates ($C_{10}$–$C_{20}$); α-olefin sulfonates ($C_{10}$–$C_{20}$); $C_{10}$–$C_{20}$ fatty acid monoglyceride sulfates; and alkyl benzene sulfonates, e.g. decyl, dodecyl, tridecyl, tetradecyl, pentadecyl (linear or branched)—benzene sulfonates; these being merely illustrative of conventional non-soap detergents useful in the compositions of this invention.

If desired one may also utilize minor amounts, e.g. about 1–20%, of non-ionic detergents, preferably those derived from linear aliphatic alcohols ($C_9$–$C_{18}$) and ethylene oxide (about 1–50 moles). Mixtures of ethylene and propylene oxide may also be used (mol ratio of P.O. to E.O. of about 5:1 to 1:10).

Other usual and conventional additives and adjuvants may be used in the soap compositions of this invention such as anti-oxidants (about 0.01 to 5%); pigments and dyes (about 0.01 to 10%); germicides, anti-bacterial and anti-fungal agents (about 0.01 to 5%); perfumes; inorganic fillers (about 0.1–10%); humectants (about 0.1–10%); conditioning agents (about 0.1–10%), chelating agents (about 0.1–5%), and the like.

The anionic maleic copolymers used in this invention may be added to the soap composition at any convenient stage of the soap manufacturing process. One may add the polymers to the kettle soap (usually about 60–70% soap—30 to 40% water); or to soap chips with or without the use of added water to facilitate homogeneous mixing. Mixing of the soap and polymer can be carried out on a conventional multi-roll mill, in a sigma blade mixer, or in the crutcher or amalgamator, and the mixture then plodded (e.g. vacuum plodded) and extruded to final bar form. Ambient temperatures may be employed, elevated temperatures of about 60°–120° C. often facilitating solubility, flowability, mixing, handling and the like. It will be understood that the term "bar" as employed herein is inclusive of any solid form in any size and shape as distinguished from compositions in the form of granules, particles, pellets, noodles and the like.

These useful anionic maleic copolymers are known and are prepared by known conventional methods for interpolymerizing maleic anhydride (or the partial, e.g. monoalkyl ester) with the selected monomer or monomers. Usually free-radical polymerization (e.g. benzoyl peroxide) is the indicated technique. Specific interpolymers by way of illustration only include the following in the indicated mole ratio:

(a) Vinyl pyrrolidone—maleic anhydride (1:1)
(b) Vinyl pyrrolidone—monomethyl maleate (1:1)
(c) Vinyl pyrrolidone—monoethyl maleate (1:2)
(d) Vinyl pyrrolidone—mono-hydroxyethylmaleate (1:3)
(e) Vinyl acetate-monomethyl maleate (1:1)
(f) $\frac{1}{3}$ methyl ester of (a)
(g) $\frac{1}{4}$ methyl ester of (a)
(h) methylvinyl ether—monomethyl maleate (1:1)
(i) methyl vinyl ether—maleic anhydride (2:3)
(j) $\frac{1}{2}$ methyl ester of (i)
(k) $\frac{1}{2}$ n-butyl ester of (i)
(l) isopropyl vinyl ether—monoethyl maleate (1:1)

The polymer partial esters may also be prepared from the corresponding maleic anhydride interpolymer and alcohol (e.g. one mole alcohol per mole of maleic anhydride in the interpolymer to give the half ester). Thus, for example 15.6 g. of methyl vinyl ether—maleic anhydride interpolymer (1:1) may be dissolved at room temperature in excess (e.g. 100 ml.) methyl alcohol to yield the $\frac{1}{2}$ methyl ester.

The interpolymers useful herein are further characterized by weight average molecular weights of about 50,000 to 5,000,000, preferably about 100,000 to 1,500,000, more preferably about 150,000 to 1,000,000.

The following examples will serve to illustrate the present invention without being deemed limited thereto. All parts and proportions referred to herein and in the appended claims are by weight unless otherwise indicated.

EXAMPLE 1

18.0 g. of a 1:1 vinyl acetate-monomethyl maleate interpolymer (MW=500,000) is dissolved in 84.0 g. of hot water (70° C.) 250 g. of soap chips (sodium soap of 85% tallow fatty acids and 15% coco fatty acids (SW chips)) are added to form a heavy paste which is milled on a small 3-roll mill. The shearing action of the rolls reduces the viscosity of the mix and then an additional 248 g. of the same soap chips are added and milling is continued. The batch is then passed six times through the rolls of a large 3-roll mill. Soap bars are pressed without vacuum treatment (i.e. non-deaerated). The bars exhibit a high degree of lubricity ("slip") and when used for handwashing produce a very high volume of a creamy, small cell, firm lather. The hands also feel very soft.

EXAMPLE 2

To 2500 g. of the soap chips of Example 1 is added, in small increments, 1 liter of water in a jacketed Sigma blade mixer, maintaining a jacket temperature of 220°–230° F. with steam. A very thick cream-like paste results. To this paste are added slowly 120 g. powder of the interpolymer of Example 1 while raising the temperature to about 215° F. A smooth, homogeneous, white paste is obtained after 1 hour mixing. The paste is tray-dried in a forced draft oven overnight at 140° F. The resultant product is then remixed in the Sigma blade mixer, milled on a 3-roll mill, spread out and allowed to air dry for about 70 hours. The moisture content of the soap mass is 3.4%. This is adjusted to 13.8% in an amalgamator and titanium dioxide (20 grams) and perfume are added. The mass is remilled to get chips. The chips are vacuum plodded and extruded to yield excellent soap bars with an initial hardness of 85–90. The soap bars are pressed in the usual manner using a standard glycerine/salt solution as parting agent. No sticking in the mold takes place.

The soap bars show high lathering capacity, a very pleasing lubricity on the skin—producing no irritation on the face, and leaving the skin soft. These characteristics are all superior to the same soap absent the polymer additive.

Wet cracking tests are carried out with the following results:

| | $\frac{1}{2}$ Hour Wet Cracking Test Index | 1 Hour Wet Cracking Test Index |
|---|---|---|
| Control Bar[1] | 50 | 43 |
| Ex. 2 Bar | 6 | 16 |

[1]The control bar is formulated and processed similarly to the Ex. 2 bar but the control bar has no polymer additive.

The $\frac{1}{2}$ hour cracking test is carried out by shaving off 25–30% of one surface of the bar which is then immersed in water at 75° F. for 30 minutes; then the bar is air dried at room temperature overnight. The number and severity of cracks is noted on shaved surface. The severity scale is from 1 to 5; 1 for pencil or hairline cracks and 5 for the deep, wide cracks. The severity scale number multiplied by the number of cracks gives the total in the Table.

The one hour cracking test is carried out in a similar manner but opposite surfaces are shaved 10% each and the bar is kept in water for one hour.

The Hardness Test employs a Dietert Hardness Meter and gives values of hardness of 0 to 100, with 0 the softest and 100 the hardest. The test employs a spring loaded ball to measure the impression of the ball on the surface of the soap bar. Values of 85 to 90 are best.

EXAMPLE 3

Example 2 is repeated using however 175 g. of interpolymer (5%). The final bars have an initial hardness of 88 to 93, and a final moisture level of 10%.

EXAMPLE 4

Example 2 is again repeated employing 87.5 g. of interpolymer. Excellent bars are obtained with a hardness, out of the plodder, of 88 to 94. In the ½ hour cracking a bar of this example has a wet cracking index of 20.

EXAMPLE 5

In this example bars are prepared containing 0, 1%, 3%, and 5% interpolymer of Example 1. The procedure involves mixing in a closed mixer (to prevent water loss) kettle soap (68% soap solids—same fatty acid chemical composition as in previous examples) at 250° F. until transparent (glassy)). The mass is then milled and amalgamated with 2.0 g. titanium dioxide and 1.5% perfume and then remilled and plodded. Moisture content, hardness and cracking index are tabulated below.

| % Polymer | Original Moisture (%) | Original Hardness (as pressed) | ½ Hour Wet Cracking Index |
|---|---|---|---|
| 0 | 10.6 | 85–88 | 126 |
| 1 | 13.8 | 89–91 | 100 |
| 3 | 12.6 | 89–92 | 70 |
| 5 | 10.5 | 90–93 | 32 |

EXAMPLE 6

To a batch of kettle soap (68% soap solids—chemically the fatty acid soaps are similar to Ex. 1) in a Reed Mixer there is added 4% by weight based on soap solids of a 1:1 maleic anhydride—vinyl acetate copolymer (M.W. is 500,000). Temperature of the batch is maintained between 235°–245° F. for 65 minutes. The batch is removed from the (sigma-blade) mixer and cooled; it is milled twice, plodded and pressed into bars. The results are:

Original hardness: 96–97
Original chip moisture: 13.0%
Moisture of soap bar: 7.5%
½ hour cracking index: 35
Same index of Control (no polymer): 120

EXAMPLE 7

Example 6 is repeated using the interpolymer of Example 1. An exceptionally outstanding bar is produced. Lather response (time) and volume are excellent. Lather texture is very thick, creamy (small bubbles) and lather stability is outstanding. The bars are tough and have excellent impact resistance. The wet "slip" is easily discernible, yet the soap dried very rapidly leaving no gelatinous, soft or slippery surface. The original hardness of the bars is 94–95; moisture content is 6.2% and the ½ hour cracking index is 16 (note: control is 120).

EXAMPLE 8

Example 6 is again repeated using at a 4% by weight level (based on soap solids) Gantrez S-97(GAF Corporation, a 1:1 methyl vinyl ether maleic acid copolymer). The bars are overall excellent in their properties. Original hardness is 91–92, moisture of bar is 8.3% and ½ hour wet cracking index is 9.

EXAMPLE 9

Example 6 is once again repeated using again, at a 4%, by weight level (based on soap solids) a 1:1 alternating copolymer of N-vinyl pyrrolidone and maleic anhydride. Processing is identical except that the jacket temperature of the Reed Mixer is 240°–248° F. Lather response excellent, sloughing non-existent and drying very rapid. The wet cracking index is 9 and the tested bar has no end cracks.

EXAMPLE 10

Example 6 is repeated using the following polymers in the indicated amounts in place of the interpolymer of Example 6:

(a) N-vinyl pyrrolidone-monomethyl maleate (1:1)—3%
(b) N-vinyl pyrrolidone-mono (hydroxyethyl) maleate (1:1)—3%
(c) ethyl vinyl ether-monomethyl maleate (1:1)—4%
(d) isobutyl vinyl ether-monoethyl maleate (1:2)—4%
(e) methyl vinyl ether-monomethyl maleate (1:1)—3%
(f) N-vinyl oxazolidinone-maleic anhydride (1:1)—4%
(g) ½ methyl ester of (f)—4%
(h) ¼ isobutyl ester of (f)—4%
(i) N-vinyl morpholinone-maleic anhydride (1:1)—4%
(j) ½ methoxytriglycol [$(CH_3O(CH_2CH_2O)_3H]$ ester of Ex. 6 copolymer—4%
(k) ¼ methyl ester of Ex. 6 polymer—4%
(l) 2/5 methyl ester of Ex. 6 polymer—3%

This invention has been disclosed with respect to preferred embodiments and it will be understood that modifications and variations thereof obvious to those skilled in the art are to be included within the spirit and purview of this application and the scope of the appended claims.

I claim:

1. A soap bar comprising a water soluble alkali metal, ammonium, or lower molecular weight amine salt of a $C_8$ to $C_{24}$ fatty acid and from about 0.1 to about 15% by weight based on the weight of said fatty acid salt of an interpolymer of (1) about 10 to 90 mole % of maleic anhydride, maleic acid, or a partial $C_1$ to $C_4$ or partial-(hydroxy-substituted $C_1$ to $C_4$ alkyl) maleate with (2) about 90 to 10 mole % of a vinyl lactam, of the formula:

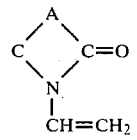

wherein A represents 2, 3 or 4 atoms selected from the group consisting of carbon, nitrogen, oxygen and sulfur atoms; a vinyl ester of a $C_2$ to $C_6$ mono carboxylic acid; or a $C_1$ to $C_4$ alkyl vinyl ether; or mixtures thereof or of (1).

2. A soap bar as defined in claim 1 wherein the fatty acid salt is a sodium salt of a $C_{12}$ to $C_{18}$ fatty acid.

3. A soap bar as defined in claim 1 wherein the fatty acid salt is a sodium salt of a mixture of fatty acids derived from about 70–90% tallow or hydrogenated tallow and 10–30% coconut oil or hydrogenated coconut oil.

4. A soap bar as defined in claim 1 wherein the interpolymer is a vinyl pyrrolidone-maleic anhydride interpolymer.

5. A soap bar as defined in claim 1 including from about 10 to 100% by weight based on soap weight of a non-soap anionic or non-ionic detergent.

6. A soap bar as defined in claim 1 wherein the interpolymer is a vinyl acetate—maleic anhydride interpolymer.

7. A soap bar as defined in claim 1 wherein the interpolymer is a methyl vinyl ether-maleic acid interpolymer.

8. A soap bar as defined in claim 1 wherein the interpolymer is a vinyl acetate-maleic anhydride partial methyl ester interpolymer.

9. A soap bar as defined in claim 8 wherein the interpolymer is a $\frac{1}{4}$ to $\frac{1}{2}$ partial ester.

* * * * *